US005791399A

United States Patent [19]

Feuerstacke

[11] Patent Number: 5,791,399

[45] Date of Patent: Aug. 11, 1998

[54] METHOD FOR HEATING A METAL MELT

[75] Inventor: Ewald Feuerstacke, Dorsten, Germany

[73] Assignee: Mannesmann Aktiegesellschaft, Düsseldorf, Germany

[21] Appl. No.: 727,536

[22] PCT Filed: Mar. 30, 1995

[86] PCT No.: PCT/DE95/00427

§ 371 Date: Oct. 24, 1996

§ 102(e) Date: Oct. 24, 1996

[87] PCT Pub. No.: WO95/29022

PCT Pub. Date: Nov. 2, 1995

[30] Foreign Application Priority Data

Apr. 26, 1994 [DE] Germany ..... 44 15 212.4

[51] Int. Cl.[6] ..... B22D 11/10

[52] U.S. Cl. ..... 164/469; 164/492; 164/494; 164/506

[58] Field of Search ..... 164/471, 48, 469, 164/492, 493, 250.1, 505, 506, 507, 472, 268, 494

[56] References Cited

U.S. PATENT DOCUMENTS

| | | | |
|---|---|---|---|
| 4,750,947 | 6/1988 | Yoshiwara | 148/12 R |
| 5,131,941 | 7/1992 | Lemelson | 75/10 |
| 5,314,003 | 5/1994 | Mackay | 164/492 |

FOREIGN PATENT DOCUMENTS 61-144249 1/1986 Japan .

*Primary Examiner*—Patrick Ryan
*Assistant Examiner*—I.-H. Lin
*Attorney, Agent, or Firm*—Cohen, Pontani, Lieberman & Pavane

[57] ABSTRACT

The invention concerns a method for heating a metal melt, in particular molten steel covered with a casting powder, introduced via a submerged outlet into an ingot mould of a continuous casting plant. In order to ensure uniform heat dissipation over the ingot mould and constant frictional forces between the latter and the casting shell, the heat energy is introduced at given points into the surface of the melt bath and the heat energy point on the surface of the melt bath is brought to a predetermined line.

2 Claims, 2 Drawing Sheets

FIG. 1a
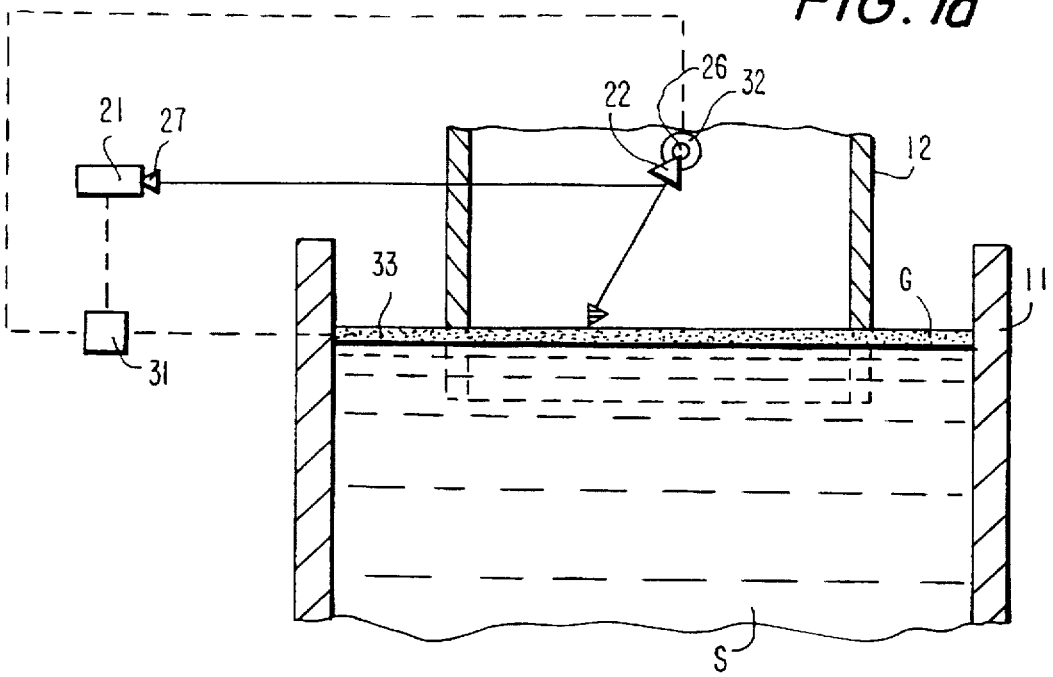
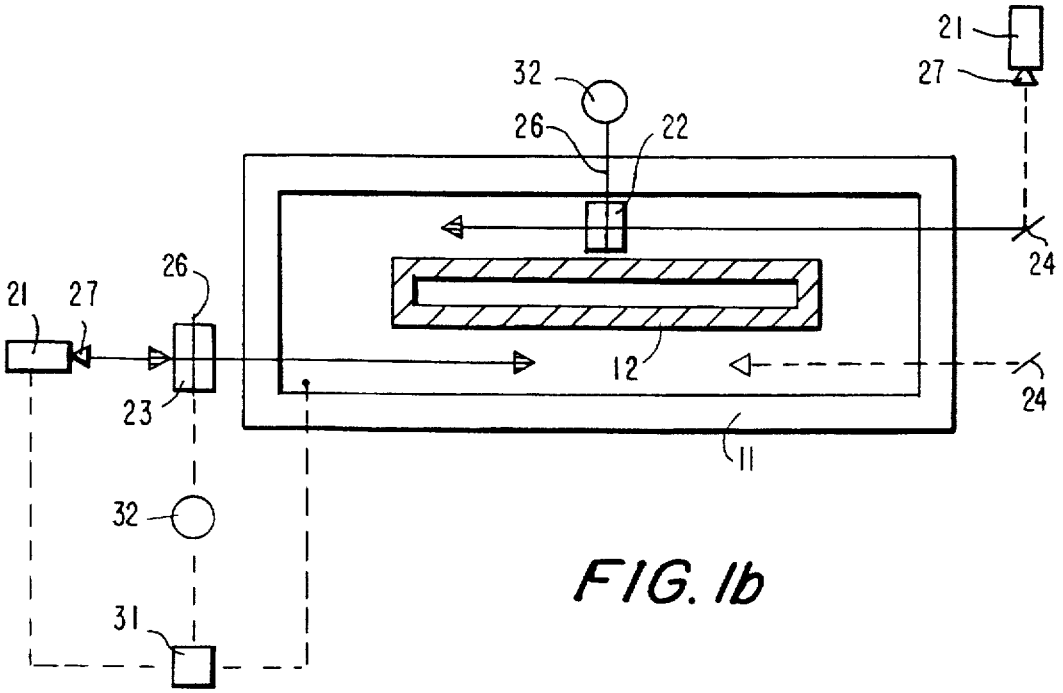
FIG. 1b

METHOD FOR HEATING A METAL MELT

CROSS-REFERENCE TO RELATED APPLICATION

This application is a 371 of PCT/DE95/00427 filed Mar. 30, 1995.

BACKGROUND OF THE INVENTION

1. Field of the Invention

The present invention is directed to a method and apparatus for heating molten metal and more particularly, to a method and apparatus for heating molten metal which has been introduced into an ingot mold of a continuous casting installation via an immersion nozzle, especially molten steel covered with a casting powder.

2. Description of the Prior Art

It is known from Japanese Patent Abstract JP-A-61-144 243 to remove solidified slag adhering to the mold wall, e.g., by means of a laser beam.

In the continuous casting of steel, adhesion forces occur between the strand and the ingot mold which can lead to high tensile stresses in the casting shell and accordingly to cracks in the surface of the billet or even to a tearing off of the strand. Therefore, in the continuous casting of steel an oscillating movement is provided between the ingot mold and the strand. In vertical continuous casting, this is generally produced by a sinusoidal up-and-down motion of the ingot mold. This mold movement prevents the newly formed casting shell from sticking to the wall of the ingot mold. Depending on the oscillating speed and casting speed, frictional forces occur between the ingot mold and the casting shell. These frictional forces depend further on the width, length, and conicity or amount of taper of the ingot mold, as well as on the lubrication. In this regard, it has been shown that a lifting platform system at a determined average casting speed causes lower frictional forces than at high or low casting speeds regardless of the dimensions of the ingot mold. It may be concluded from this that the mold lift and the casting lubrication must be optimally adjusted to the casting conditions.

The casting powder located on the melt has an effect on the flow of heat carried off along the ingot mold. The differences in the heat flux caused by the casting aids are most pronounced in the region of the meniscus and decrease toward the ingot mold outlet. It may be concluded from this that the thickness of the casting shell is influenced by the casting aids substantially only in the region of the meniscus.

It has been shown that the heat flux density in an ingot mold increases as the casting speed increases. The heat carried off is at its highest in the meniscus. This is because the liquid steel is in close contact with the wall of the ingot mold and has the highest temperature in this area. With the extensive heat extraction, the casting shell cools off and, in so doing, shrinks and pulls away from the wall of the ingot mold. The type of casting powder and its more heat is carried off from the liquid steel in the ingot mold when the casting powder has a low melting point than with higher-melting casting powder. An even greater increase in the heat carried off was determined when using rapeseed oil as a mold lubricant.

Insufficient dissipation of heat is one cause of breakout in continuous casting. In general, a weakening of the casting shell in the ingot mold precedes breakout; that is, a crack occurs in the casting shell or the slag has prevented the heat from being carried off through the casting shell. Cracks in the casting shell occur, for example, because of suspension during or after the overflow of the ingot mold or during bridging between the immersion nozzle and casting shell.

SUMMARY OF THE INVENTION

Therefore, the object of the present invention is to provide a method and apparatus which ensure a uniform dissipation of heat along the ingot mold and additionally ensure constant frictional forces between the casting shell and ingot mold.

In the present invention, heat energy is introduce d from a heat energy source onto the surface of a metal melt or metal bath in a punctiform or concentrated point-like manner. As used herein, punctiform means that the heat energy is provided as a concentrated or point-like source of energy, as is characteristic of laser energy sources and laser beams. In a preferred embodiment, the heat energy source is a laser beam. The heat energy point provided by the heat energy source or laser beam is guided on the surface of the metal melt along a predefinable line or path. The distinguishing characteristics of a laser beam, e.g. high monochromaticity, coherence, parallelism and energy density, make it possible to heat or melt materials, including metals, within narrowly defined regions or areas. The quality of the laser beam depends, in part, on the adjustment, diameter, performance stability and focus of the laser beam source. In turn, the laser beam quality and its intensity influence the quantity of work that can be performed by a particular laser beam source. By varying the quantity of work being performed, the intensity of the laser beam can likewise be varied.

When using steel as the material in a continuous casting process, the critical region or area of the material for heat dissipation is the concave or convex upper surface or meniscus of the metal melt. This area or region can be directly influenced by the laser beam, which can be located outside of the continuous casting or ingot mold.

According to the present invention, a molten metal is introduced into an ingot mold of a continuous metal casting operation via an immersion nozzle. The ingot mold and immersion nozzle are generally rectangular in shape, both having a pair of relatively long side walls and a pair of relatively short side walls. The longitudinal side walls of the immersion nozzle are shorter in length than the longitudinal side walls of the ingot mold. The immersion nozzle is partially submerged in the molten metal within the ingot mold thereby defining a region or area on the surface of the metal which extends along and between the longitudinal side walls of the ingot mold and the longitudinal side walls of the immersion nozzle. This region or area extends only between the opposite ends of the longitudinal walls of the immersion nozzle and is referred to as the shadow region or area. The remaining region or area on the surface of the molten metal, i.e. that area beyond the opposite ends of the longitudinal side walls of the immersion nozzle, is referred to as the free region or area.

The molten metal has a natural flow characteristic within the ingot mold which is determined by the specific composition of the metal.

A casting powder placed on the surface of the molten metal further ensures heat dissipation from the ingot mold.

In a preferred embodiment of the present invention, heat energy from a laser beam is introduced as a heat energy point onto the surface of the molten metal at a starting point defined at the center of the shadow region or area. The heat energy point is then moved from its starting point to a point located on the surface of the metal in the free region or area.

In so moving the heat energy point, the starting point, end point, path and velocity of travel are controllable and selectable to maximize the heat dissipation from the surface of the molten metal. In a particularly preferred embodiment, the travel path of the heat energy point follows the natural flow characteristic of the molten metal.

According to present invention, the heat energy which is introduced in a punctiform manner, is adjusted in a predefinable manner not only with respect to the level of its heat energy, but also with respect to its period of use. Thus, it is proposed to move the heat energy point in the regions between the immersion nozzle and the corresponding longitudinal side of the ingot mold edge. In so doing, the starting point, the end point, and the path and velocity of the heat energy source, i.e. laser beam, between these points can be freely selected.

The equipment for generating the laser beam can be arranged at a safe location outside the ingot mold and immersion nozzle. The laser beam can be guided via a mirror to the desired region at the surface of the melt.

BRIEF DESCRIPTION OF THE DRAWINGS

In the drawings, wherein like reference characters are used to denote similar elements throughout the several views:

FIG. 1*a* is a cross-sectional view of a continuous casting installation configured in accordance with the present invention;

FIG. 1*b* is a diagrammatic representation of a continuous casting installation having two laser energy sources configured in accordance with the present invention;

DETAILED DESCRIPTION OF THE PRESENTLY PREFERRED EMBODIMENTS

Figure 2A:
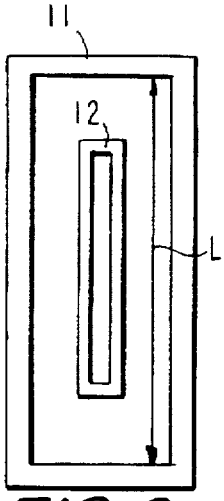
FIG. 2*a* is a diagrammatic representation of the path followed by a heat energy point as it moves along the surface of a metal melt in accordance with the present invention.

Referring now to the drawings, FIGS. 1*a* and 1*b* show, respectively, cross-sectional and diagrammatic views of a of the continuous casting arrangement 10 configured in accordance with the present invention. A melt S on which a casting powder G floats is located in an ingot mold 11. An immersion nozzle 12 is submerged in the melt S.

A laser energy source 21 is arranged outside the continuous casting arrangement 10. A laser beam is guided from the laser energy source 21 via a laser optical system 27 onto the surface of the melting bath S on opposit sides of the immersion nozzle 12 via a movable central mirror 22 and a movable external mirror 23, respectively. The laser energy source 21 can be positioned so that the laser beam contacts the mirrors 22, 23 directly. In an alternative embodiment, the laser energy source 21 can be positioned outside of the continuous casting arrangement 10 and the laser beam directed onto the surface of the metal melt via positionable mirrors 24. In this configuration, a single laser energy source 21 can be used to contact the surface on both sides of the immersion nozzle 12 by using two positionable mirrors 24. The mirrors 22, 23 move in an oscillating manner under the control of the control unit 32 to direct the heat energy point from the laser energy source 21 onto the surface of the metal melt. The heat energy point is directed onto the surface of the metal melt beginning in the center of the shadow region, following a predefinable path toward the free region, and returning therefrom to the shadow region.

The mirrors 22 and 23 are swivelable about an axle 26. The axle 26 is connected to a control unit 32 which communicates with a computing element 31. This computing element 31 is connected by way of measurement circuits with a temperature gauge 33 and by way of control circuits with a laser energy source 21.

Referring now to FIG. 1*b*, and in particular, to the embodiment illustrated on the right-hand side thereof, two positionable mirrors 24 are disposed external to the continuous casting arrangement 10 and located on opposite longitudinal sides of the nozzle 12. In this configuration, the laser energy source 21 can be directed onto the surface of the metal melt in the shadow region on either side of the nozzle 12. By impinging on the positionable mirror 24 near or proximal to the laser energy source 21, the laser beam can be directed onto the surface of the metal melt located at the top (in the figure) of the ingot mold 11. The stationary mirror 24 near or proximal to the laser energy source 21 can then be swiveled out of the path of the laser beam so that the beam impinges on t he distal positionable mirror 24 and is directed onto the surface of the metal melt located at the bottom (in the figure) of the ingot mold 12. In this manner, the laser energy source 21 can contact the surface of the metal melt S on either side of the nozzle 12.

FIG. 2*a* diagrammatically illustrates the path L followed by the energy point from a laser energy source 21 as it moves along the surface of a metal melt in the region or area between the ingot mold 11 and the immersion nozzle 12.

Figure 2B:
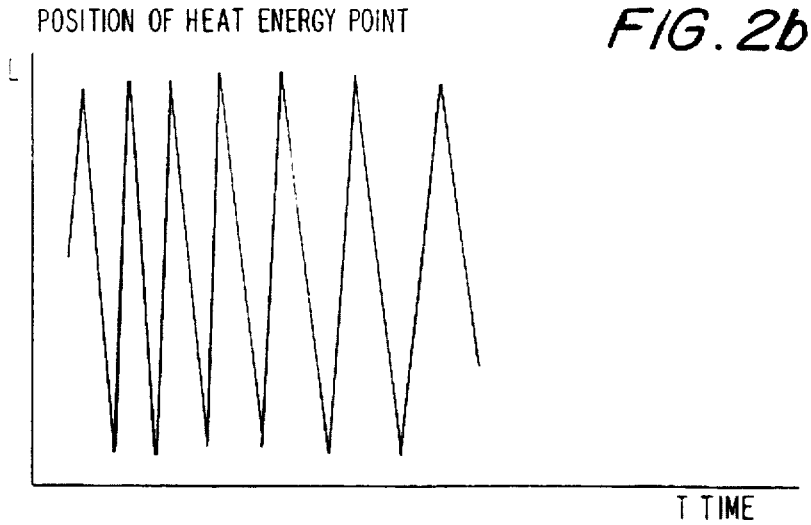
FIG. 2*b* is a graphical illustration of the relationship between time and the position of the heat energy point as it moves along the surface of the metal melt beginning in the center of the shadow region and travelling therefrom to opposite ends of the ingot mold.

FIG. 2*b* graphically illustrates the relationship between time and the path L of an energy point from a single laser energy source 21 as the energy point oscillates between the free regions located at opposite ends of the ingot mold 11. The energy point begins at the center of shadow region, travels toward the free region at one end of the ingot mold 11, and passes through the shadow region as it travels in the opposite direction toward the free region at the other end of the ingot mold 11. The energy point oscillates from one end of the ingot mold 11 to the other as it is guided back and forth uniformly by the movement of the mirrors 22, 23 under the control of the control unit 32. In this embodiment, the energy point contacts the surface of the melt S only on one side of the metal melt or bath.

Figure 2C:
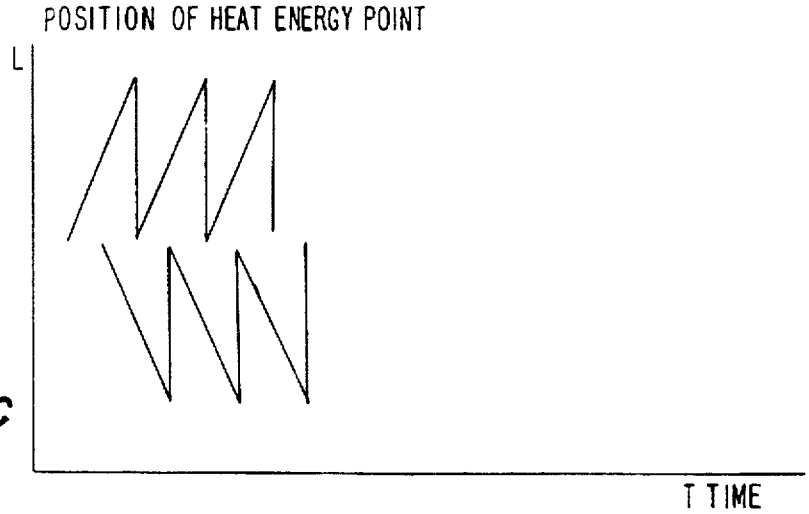
FIG. 2*c* is a graphical illustration of the relationship between time and the position of two heat energy points as they move along the surface of the metal melt beginning in the center of the shadow region and travelling therefrom to opposite ends of the ingot mold.

FIG. 2*c* graphically illustrates the relationship between time and the path L of two energy points from two laser energy sources 21 as each energy point oscillates between the center of the shadow region and the free regions located at opposite ends of the ingot mold 11. The energy points begin at the center of the shadow region and travel in opposite directions as they oscillate between the center of the ingot mold 11, i.e. the shadow area or region, and the end of the ingot mold 11, i.e. the free region or area. The energy points move slowly along the surface of the melt S as they travel from the shadow region to the free region and then return more rapidly from the free region to the shadow region in a jerking manner.

Figure 2D:
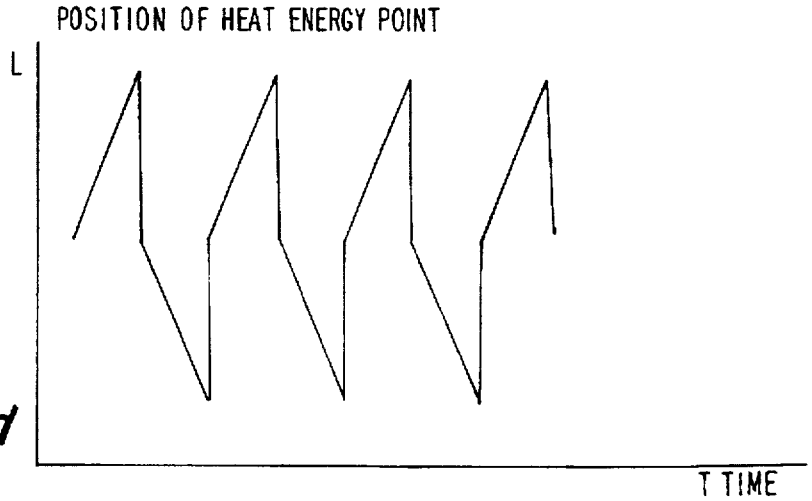
FIG. 2*d* is a graphical illustration of the relationship between time and the position of a heat energy point as it moves along the surface of the metal melt beginning in the center of the shadow region and travelling therefrom to opposite ends of the ingot mold.

FIG. 2*d* graphically illustrates the relationship between time and the path L of an energy point from a single laser energy source 21 as the energy point oscillates between the shadow region and the free regions located at opposite ends of the ingot mold 11. The energy point begins in the center of the shadow region and then travels slowly along the surface of the metal melt outward towards the free region. From the free region, the energy point is jerked rapidly back toward the center of the shadow region. The energy point then travels slowly in the opposite direction outward toward the free region, and is jerked back toward the center of the shadow region as described above.

I claim:

1. A method of heating molten metal having a surface, wherein the molten metal is introduced into a mold having a longitudinal side wall via an immersion nozzle having a longitudinal side wall the immersion nozzle being partially submerged in the molten metal thereby defining a first region on the surface of the molten metal between the longitudinal side wall of the mold and the longitudinal side wall of the immersion nozzle, the longitudinal side wall of the immersion nozzle having opposite ends and being shorter in length than the longitudinal side wall of the mold, a second region being defined on the surface of the molten metal beyond the opposite ends of the longitudinal side wall of the immersion nozzle, the molten metal flowing within the mold in a predetermined direction, said method comprising the steps of:

(a) introducing heat energy onto the surface of the molten metal so as to form a heat energy point thereon; and (b) guiding said heat energy point on and along the surface of the molten metal along a path beginning at the center of the first region and ending in the second region, said path following the direction of flow of the molten metal.

2. A method of heating molten metal having a surface, wherein the molten metal is introduced into a mold having a longitudinal side wall via an immersion nozzle having a longitudinal side wall, the immersion nozzle being partially submerged in the molten metal thereby defining a first region on the surface of the molten metal between the longitudinal side wall of the mold and the longitudinal side wall of the immersion nozzle, said method comprising the steps of:

(a) introducing heat energy onto the surface of the molten metal so as to form a heat energy point thereon; and (b) guiding said heat energy point on and along the surface of the molten metal along a predefinable line in the first region.

* * * * *